United States Patent [19]

Osborn

[11] Patent Number: 4,834,697

[45] Date of Patent: May 30, 1989

[54] DRIVEN GUIDE ROLLER INDEXING SYSTEM

[75] Inventor: Paul V. Osborn, Webster, N.Y.

[73] Assignee: Mobil Oil Corporation, New York, N.Y.

[21] Appl. No.: 52,320

[22] Filed: May 21, 1987

[51] Int. Cl.[4] ..... B31B 1/10; B65A 20/24

[52] U.S. Cl. ..... 493/193; 493/24; 493/29; 493/225; 226/108; 226/114; 226/117

[58] Field of Search ..... 226/108, 113, 114, 115, 226/117; 493/24, 29, 30, 194, 195, 196, 201, 225

[56] References Cited

U.S. PATENT DOCUMENTS

| | | | |
|---|---|---|---|
| 1,699,507 | 1/1929 | Spiess | 226/114 |
| 2,897,729 | 8/1959 | Ashton et al. | 493/196 |
| 3,526,563 | 9/1970 | Schott, Jr. | 226/113 |
| 3,722,376 | 3/1973 | Wech | 493/34 |
| 3,878,114 | 4/1975 | Lancor, Jr. et al. | 226/113 |
| 3,926,355 | 12/1975 | Bonnell | 226/117 |
| 4,624,654 | 11/1986 | Boyd et al. | 493/194 |
| 4,702,731 | 10/1987 | Lambrecht et al. | 493/196 |

FOREIGN PATENT DOCUMENTS

| | | | |
|---|---|---|---|
| 128239 | 8/1927 | Switzerland | 226/114 |

*Primary Examiner*—Frederick R. Schmidt
*Assistant Examiner*—William E. Terrell
*Attorney, Agent, or Firm*—Alexander J. McKillop; Charles J. Speciale

[57] ABSTRACT

A plastic film product manufacturing apparatus includes a pair of draw rollers advancing a continuous length of plastic film, a plurality of guide rollers guiding the plastic film through at least part of the apparatus to the draw rollers and an endless flexible belt driving each of the guide rollers at a circumferential surface speed equal to the speed of the continuous length of plastic film advanced over the guide rollers. When the continuous length of plastic film is intermittently advanced by the draw rollers, and the guide rollers are simultaneously intermittently rotated by the endless belt. A primer mover drives both the draw rollers and the endless flexible belt to coordinate rotation of the draw rollers with the rotation of the guide rollers. One of the guide rollers is mounted on a dancer arm and a system of pulleys is provided for driving that guide roller by the endless flexible belt.

3 Claims, 3 Drawing Sheets

DRIVEN GUIDE ROLLER INDEXING SYSTEM

This invention is related to my invention disclosed in my patent application entitled, "Cam Positioned Index Take Up Roll", Ser. No. 052,302 concurrently filed herewith, and incorporated herein by reference.

FIELD OF THE INVENTION

This invention relates to plastic film handling apparatus and methods and, in particular, to apparatus and methods for intermittently advancing thin plastic film webs for high speed plastic film product manufacture.

BACKGROUND OF THE INVENTION

U.S. Pat. No. 4,624,654 -Boyd et al assigned to the assignee of this invention and incorporated by reference, describes a line for manufacturing draw tape bags from a continuous web of thin plastic film. The continuous plastic film web is fed from a supply roll and drawn through an upstream portion of the line, including a first group of work stations, by means of a first pair of input nip rolls which are continuously rotated. The continuous plastic web is intermittently advanced away from the input nip rolls and through a second group of work stations in a downstream portion of the line by a second pair of intermittently moving nip or draw rolls. The continuous web is accumulated between the first pair of nip rolls and the downstream work stations in a dancer. Several other guide rolls are provided between the dancer and the draw rolls in order to guide the intermittently advanced plastic film web through the downstream portion of the line.

It is been found in operating a bag manufacturing line of the type described in the aforesaid U.S. Pat. No. 4,624,654 at higher cycling speeds that the intermittent advancement of the continuous plastic film web through a multiroll dancer and a multiplicity of idler rolls in the downstream portion of the line introduces widely varying tension in the film which adversely affects film tracking, leading to problems such as wrinkling, and operations such as heat sealing. These adverse effects, resulting from the introduction of varying tension in the film web, limit the maximum speed at which the web can be intermittently advanced, and thus the cycling speed of the line.

SUMMARY OF THE INVENTION

It is an object of the invention is to reduce tension variations in a continuous length of plastic film fed over a plurality of rollers guiding the continuous length of plastic film through at least part of the manufacturing apparatus or process, particularly where the film is intermittently advanced over the guiding rollers, by the provision of a drive which rotates the guiding rollers at a circumferential surface speed equal to the speed at which the film is advanced, thereby effectively decoupling the inertia of the rollers from the film. In an embodiment described in detail, a conventional plastic bag manufacturing machine including a pair of draw rollers or the like, is cyclicly operated for intermittently advancing a continuous length of plastic film over a plurality of individual guide rollers, cyclicly drives the individual guide rollers at the same circumferential surface speed as the film advanced by the draw rollers. This is accomplished by the provision of a coupling between an electric motor which drives the draw rollers and each of the driven guide rollers.

According to another aspect of the invention, a guide roller is provided on a dancer arm end, the dancer arm end guide roller is also driven. According to this aspect of the invention, the dancer arm roller is driven with the other individual guide rollers by means of an endless flexible coupling such as a belt, or the like frictionally or mechanically engaged with each of the rollers.

For a more detailed disclosure of the invention and for further objects and advantages thereof, reference is to be had to the accompanying drawings and following detailed description of a preferred embodiment.

DETAILED DESCRIPTION OF THE PREFERRED EMBODIMENT

The invention can be incorporated into a bag line such as the draw tape bag line described in the aforesaid U.S. Pat. No. 4,624,654 incorporated by reference.

Figure 1:
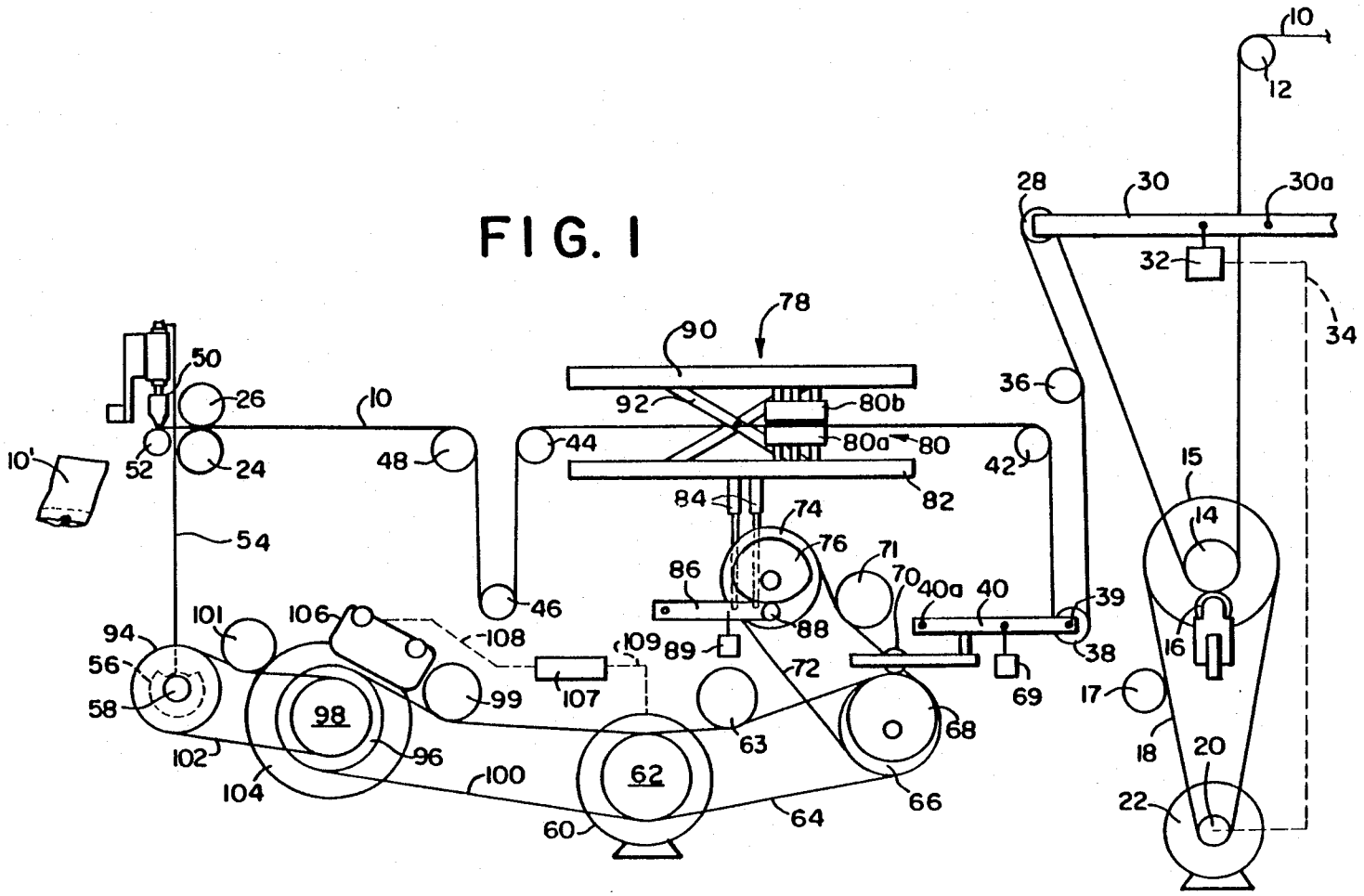
FIG. 1 is a diagrammatic side elevation illustrating the components of a plastic bag making machine incorporating the guide roller drive of the subject invention.

Referring to FIG. 1, a continuous thermoplastic film web 10 is continuously drawn from a supply roll (not shown) over a first idler roll 12 by a capstan 14 and pinch roll 16 to a roller 28 supported on the end of a counter weighted dancer arm 30 which is free to rotate about a central shaft 30*a*. The capstan 14 is driven by means of a belt 18 around a pulley portion 15 of the capstan 14 and a pulley 20 driven by an electric motor 22. A variable transducer 32 coupled with the arm 30 supplies a varying signal over a suitable channel, indicated by broken line 34, to the capstan motor 22 adjusting the speed of the capstan 14 with movement of the dancer arm 30. The film web 10 continues over a stationary idler roller 36, around guide roller 38 supported on a shaft 39 on a second dancer arm 40 and over stationary guide rollers 42, 44, 46, and 48 to draw rolls 24 and 26. Each of the rolls 36, 42, 44, 46 and 48 and the pivots 30*a* and 40*a* for arms 30 and 40 are supported by stationary frame members omitted from the figures for clarity. Draw rolls 24, 26 intermittently advance one bag width (or length) of film web 10 at a time between a heater/sealer bar 50 reciprocating against an anvil in the form of roller 52 in the bag machine. The bar 50 seals the trailing side edge of an individual bag body 10' and severs it from the continuous length of film web 10. The bar 50 concurrently seals the leading side edge of the succeeding bag body in the film web 10 and is reciprocated by means of a mechanical linkage represented by a push rod 54 activated by a cam 56 supported on a main shaft 58 beneath the seal bar.

The film contacting portions of each of the rolls 36, 38, 42, 44, 46 and 48 is the cylindrical outer surface of a hollow, hard anodized uniform outer diameter aluminum tube. Friction between the uniform diameter aluminum cylindrical surface of the rolls and the film is the only means of engagement between the film and these rollers In the absence of the guide roll drive of this invention, the film would have to overcome the rotational inertia of the rollers when the film is accelerated by the draw rolls. This would introduce varying tensions in the film which are unacceptable for high speed bag making operations.

A main motor 60 drives a double pulley 62 connected by a first belt 64 to a second double pulley 66 which is fixed with a cam 68. An air cylinder 69 pulls pivotally supported arm 40 down so that the cam 68 is contacted by a cam follower 70 depending from the arm 40. A belt 72 couples pulley 66 with a pulley 74 coupled with a cam 76 for operating a presealer 78. The presealer 78 is adapted to preseal the ends of the draw tapes in the bags 10' as hereinafter described. The presealer 78 includes one or more pairs of reciprocated heated metallic jaws 80. The electrical heating connections for the jaws are conventional and omitted for clarity. The jaws 80 can be mounted and actuated in various ways, one of which is shown by way of example. The lower jaw **80*a* is fixed to a lower member 82 which is raised and lowered by a linkage represented by rods 84 coupled to a pivoted arm 86 supporting a cam follower 88. The follower 88 engages the cam 76 and arm 86 is raised by an air cylinder 89. The upper jaw 80*b* is fixed to an upper support member 90 coupled with lower support member 82 through a linkage 92 for cooperation of the lower end and upper jaws 80*a* and 80*b***. A stationary frame supporting the illustrated elements is omitted from the figures for clarity.

The presealer assembly 78 forms a heat seal at regularly intervals along the film web 10 where the web will be subsequently contacted by the heated sealer/cutter bar 50. The bar 50, as previously described, is operated to heat seal only a very narrow transverse strip forming a side edge of each produced plastic bag 10'. The presealer 78 forms a heat seal in a hemmed region of the web 10 containing more than two layers of thermoplastic film, such as the hem region of a draw tape bag containing six or more layers of thermoplastic film, including the ends of the draw tapes.

The pulley 62 is also coupled to a pulley 94 on main shaft 58 through coaxial pulleys 96, 98 and belts 100, 102. Coaxially supported with coaxial pulleys 96 and 98 is a brake disc 104. A brake pad assembly 106 is also supported by the stationary frame (not shown) for engagement with brake disc 104. The brake formed by disc 104 and pad assembly 106 is used to stop the coaxial pulleys 96, 98 as well as the other pulleys 94, 62, 66 and 74 coupled to those pulleys 96 and 98. The motor 60 and brake 104/106 are linked with a common controller, indicated diagrammatically by block 107, by suitable connection means, indicated diagrammatically by broken lines 108 and 109. The motor 60 runs continuously when the bag machine is running. When the motor 60 is on the brake 104/106 is off and vice versa. The brake provides for a fast stop and prevents static machine loads from moving the stopped position to a different point in the cycle. This is important for cycle timing set up. The movable pulleys 17, 63, 71, 99, and 101, are provided for tensioning the belts 18, 64, 72, 100 and 102, respectively.

The various elements 24, 26, 50, 52, 54, 56, 58, 60, 62, 94, 96, 98, 99, 100, 101, 102, 104, 106–109 are all conventional and may be found in such devices as the Amplas Model No. 1402 bag machine.

The cam driven dancer arm 40 is the subject of my related application Ser. No. 052,302 filed herewith, referred to above and incorporated by reference herein.

Figure 2:
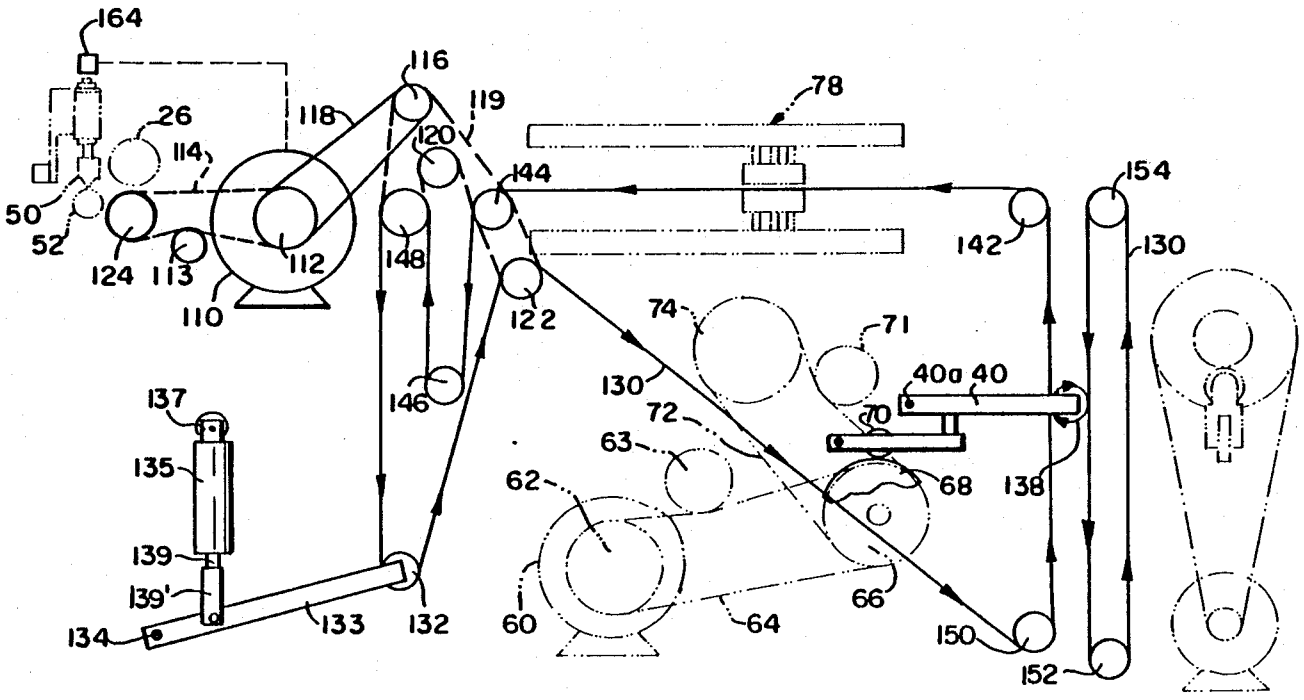
FIG. 2 is a diagrammatic side elevation of a drive belt and pulley system linking the driven guide rolls of FIG. 1 with one another.

Referring now to FIG. 2, there is illustrated the pulley and belt system employed to simultaneously drive each of the guide rolls 38, 42, 44, 46, and 48, FIG. 1, at a surface circumferential speed identical to the speed of the film web 10 intermittently advanced by the nip rolls 24 and 26 from the capstan 14 and pinch roll 16.

Figure 3:
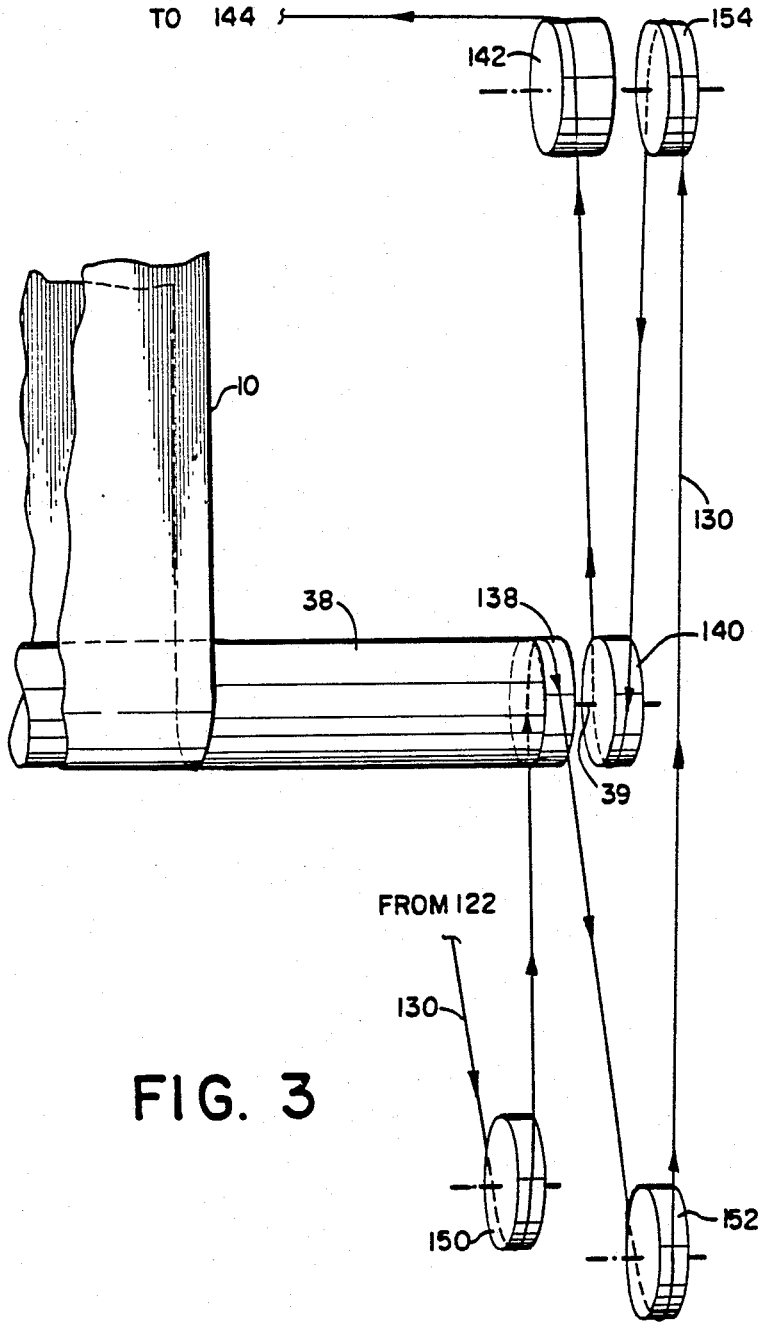
FIG. 3 is a perspective, partially exploded view showing the relation of the dancer arm supported guide roller and pulleys supporting an endless drive belt from the right-hand end of FIG. 2.

A motor 110, FIG. 2, supports and drives a double pulley 112. The motor 110 is a servo drive which goes through precise single movement when triggered. In a single cycle the motor 110 accelerates the draw rolls 24, 26 and the guide rolls at **5*g* to a constant velocity (900 ft/min.) and at the time necessary for a precise index length, for example 30", decelerates the draw rolls and the guide rolls to stop. A pulley 124, coaxial with and fixed to the draw roller 24 of FIG. 1, is driven by pulley 112 through a continuous belt 114. The continuous belt 114 is indicated by broken lines for clarity. A jackshaft supported double pulley 116 is also driven by motor 110 by an endless flexible belt 118 around pulleys 112 and 116. The jackshaft double pulley 116 is supported on one side of the bag machine line by a stationary frame member which has been omitted from the figures for clarity. The jackshaft double pulley 116 in turn drives another endless flexible belt 119 which passes from pulley 116 around a double pulley 148, coaxial to and joined with the idler roll 48 (FIG. 1), around a take-up pulley 120, also supported from the one side of the frame, around a double pulley 122 also supported on the one side of the frame, and back around pulley 116. The various other stationary guide rolls 42, 44 and 46 of FIG. 1 are commonly driven from double pulleys 122 and 148 by a continuous flexible belt 130 passing over the double pulley 148 and around a take-up pulley 132 to double pulley 122. The pulley 132 is supported by an arm 133 pivotally mounted at pivot 134 to a frame member (not shown) and loaded by an air cylinder 135, in turn pivotally mounted to a stationary frame member (not shown) by a clevis 137. The cylinder 135 is pivotally connected to the arm 133 by a clevis 139' on a piston arm 139. The endless belt 130 is also used to drive guide roll 38 on dancer arm 40. This is best seen in FIG. 3. After passing over pulley 122, belt 130 passes around a stationary pulley 150, over a first pulley 138 coaxial with and fixed to dancer roll 38 on shaft 39, down and around a stationary pulley 152, over another stationary pulley 154, down and around a second, free-wheeling pulley 140 coaxially mounted on shaft 39 with the dancer roll 38 on arm 40 and over a width of double width pulley 142 coaxial with and fixed to guide roll 42. Since the pulleys 138 and 140 turn in the same direction and at the same speed, i.e. film speed, they may comprise a common double pulley. Referring to FIG. 2, from pulley 142 the belt 130 continues over pulleys 144 and 146 coaxial with and joined to guide rollers 44, 46, respectively, FIG. 1, and back to pulley 148**.

The servo motor 110 is synchronized with the operation of the motor 60 and when triggered is operated for a fixed period of time sufficient to index a bag width (or length) of the continuous length of film web between the bar 50 and roller 52. The motor 110 is triggered by a switch 164, FIG. 2, electrically connected thereto and, activated by the cam 56 on the main cam shaft 58, FIG. 1. The index is started just after the heated sealer/-cutter bar 50 and the jaws 80 of the presealer 78 retract from the film 10.

White the guide rolls 38–48 may be driven by a single continuous belt 130 along one side of the apparatus, for faster or more positive operation it may be desirable to duplicate the endless belt drive at the other end of the guide rolls 38–48 on the opposite side of the apparatus.

One of ordinary skill in the art will understand that the various guide rolls 42, 44, 46 and 48 will also be held stationary by the endless belt 130 between the intermittent actuation of the draw rolls 24 and 26. The guide rolls, being frictionally coupled with the continuous plastic film, will thus tend to hold the film web stationary between indexing movements. However, the belt 130 will still cause the dancer arm supported roller 38 to rotate, even when belt 130 is stationary when the dancer arm 38 is actuated by cam 68.

In the described embodiment the rolls were approximately 2½ inches in diameter and a driving belt 130 of approximately 260 inches in length was used. The belt 130 was designed to be accelerated and decelerated at 5 G's between speeds of 0 and 930 feet per minute at a rate of 135 cycles per minute. At maximum acceleration and deceleration, tension in the belt can reach as much as 100 lbs., while nominal tension is about 10 lbs. The belt was a ½" by ¼" aramid reinforced endless woven polyurethene covered belt.

While belts and pulleys have been employed, it is to be understood that other equivalent other conventional endless flexible couplings or linkages may be used such as a chain and sprocket, or pulley with a cable, rope or wire.

Although a preferred embodiment of the invention has been described and some modifications thereto suggested, it will be understood that other variations and changes may be made without departing from the spirit and scope of the invention as set forth in the appended claims.

What is claimed is:

1. A plastic film product manufacturing apparatus of the type for receiving a continuous length of plastic film continuously drawn from a supply roll comprising:

means for advancing a continuous length of the plastic film;

a plurality of rotatable guide rollers each roller having a uniform cylindrical surface for frictionally engaging and for guiding a continuous length of the plastic film through at least part of the apparatus to the advancing means;

roller drive means coupled with the plurality of guide rollers and rotating each of said plurality of guide rollers at a circumferential surface speed equal to the speed of the continuous length of plastic film advanced over each guide roller by the advancing means for decoupling rotational inertia of the guide rollers from the plastic film;

a dancer arm roller mounted on a dancer arm for movement along an arc for continuously receiving the continuous length of plastic film from the supply roll and for cooperating with said plurality of guide rollers for guiding a continuous length of plastic film to said advancing means;

said roller drive means being coupled with said dancer arm roller for rotating said dancer arm roller;

said roller drive means comprising an endless flexible coupling means for rotating each of said dancer arm roller and said plurality of guide rollers;

prime mover means coupled with said advancing means and with said endless flexible coupling means, said prime mover means comprising an electric servo motor, pulley means, said pulley means being driven by said prime mover and being coupled with said advancing means and being coupled with said endless flexible coupling means, and, means for cyclically operating said prime mover means for simultaneously intermittently actuating and advancing means and said endless flexible coupling means to intermittently advance the continuous length of plastic film while permitting continuous rotation of said dancer arm roller when said advancing means and said endless flexible coupling means are at rest.

2. The apparatus of claim 1 further comprising:

a reciprocating action, plastic film heat sealing device; and timing means for synchronizing reciprocation of the heat sealing device with intermittent operation of the prime mover means.

3. The apparatus of claim 1 wherein said roller drive means further comprises:

first flexible coupling turning means fixedly coupled with the dancer arm roller for receiving the flexible coupling means;

second flexible coupling turning means rotatably supported on said dancer arm for movement with said dancer arm roller and coaxial with the first flexible coupling turning means and for guiding the flexible coupling means to one of said guide rollers; and third and fourth flexible coupling turning means fixedly positioned on one of the dancer arm for guiding said endless flexible coupling means between said first flexible coupling turning means and said second flexible coupling turning means.

* * * * *